US005813138A

United States Patent [19]

Barabé et al.

[11] Patent Number: 5,813,138

[45] Date of Patent: Sep. 29, 1998

[54] AERATED BELT CONVEYOR SYSTEM FOR CONVEYING HOT EXPANDED MINERALS

[76] Inventors: Richard Barabé , 7602, St-Denis, Montréal, Québec, Canada, H2R 2E6; Yvan Boisvert, 48, de l'Église, Baie du Fèbvre, Québec, Canada, J0G 1A0

[21] Appl. No.: 770,591

[22] Filed: Dec. 19, 1996

[51] Int. Cl.[6] ..... F26B 17/00

[52] U.S. Cl. ..... 34/580; 34/136; 34/182; 34/208; 34/217

[58] Field of Search ..... 34/579, 580, 62, 34/66, 85, 130, 135, 136, 142, 166, 182, 183, 208, 217, 227, 236; 198/213, 790; 252/378 P; 432/13, 16

[56] References Cited

U.S. PATENT DOCUMENTS

| | | | |
|---|---|---|---|
| 3,884,668 | 5/1975 | Suzuki et al. | 65/142 |
| 4,179,264 | 12/1979 | Vancauwenberghe | 432/13 |
| 4,312,659 | 1/1982 | Panarello et al. | 65/84 |
| 4,347,155 | 8/1982 | Jenkins | 252/378 P |
| 4,525,388 | 6/1985 | Rehder et al. | 427/221 |
| 5,002,696 | 3/1991 | White | 252/378 R |
| 5,062,219 | 11/1991 | Harris et al. | 34/133 |
| 5,207,830 | 5/1993 | Cowan et al. | 106/672 |
| 5,211,557 | 5/1993 | Tokitsu | 432/243 |
| 5,340,509 | 8/1994 | Chang et al. | 264/5 |
| 5,527,458 | 6/1996 | Gehrmann et al. | 34/217 X |

FOREIGN PATENT DOCUMENTS 42 17 056 11/1993 Germany .

*Primary Examiner*—Henry A. Bennett
*Assistant Examiner*—Steve Gravini
*Attorney, Agent, or Firm*—Goudreu Gage Dubuc & Martineau Walker

[57] ABSTRACT

An aerated belt conveyor system for conveying hot expanded minerals including a longitudinal power driven belt conveyor surrounded by an envelope is described herein. An exhauster creates an air flow in the envelope to aerate expanded mineral material conveyed by the power driven belt conveyor and cool the mineral material to an adequate bagging temperature.

17 Claims, 5 Drawing Sheets

AERATED BELT CONVEYOR SYSTEM FOR CONVEYING HOT EXPANDED MINERALS

FIELD OF THE INVENTION

The present invention generally relates to power driven conveyors. More specifically, the present invention relates to an aerated power driven belt conveyor system for conveying hot expanded minerals.

BACKGROUND OF THE INVENTION

Numerous processes are known to cause certain specific minerals, such as perlite and vermiculite, to undergo an expansion phase where the volume of the mineral increases while the weight of the mineral stays constant. As a result of these processes, the density of the mineral is decreased.

These processes typically involve introducing the mineral to be expanded in a kiln which is at a high temperature and leaving the mineral in this kiln for a predetermined period of time, causing the expansion of the mineral by way of heat.

The expanded pieces of mineral exiting the kiln are usually very hot, e.g. in excess of 2500° F. (1400° C.), and must therefore be cooled prior to be put in sacks for shipping. Indeed, no conventional sacks would resist such high temperatures.

Furthermore, since the kiln used in the expansion process usually includes gas burners to generate the heat required to expand the mineral, the expanded mineral exiting the kiln must be separated from the combustion gases of the gas burners.

Conventionally, a cyclone is used to separate the expanded mineral from the combustion gases of the kiln. The cyclone also has the secondary effect of partially cooling the expanded mineral. However, the cooling effect of the cyclone is not sufficient to bring the expanded mineral to an adequate bagging temperature. Indeed, the temperature of the mineral pieces exiting the cyclone through a material outlet often exceeds 1500° F. (800°C.).

One solution to the cooling problem is to use an air conveying system to transport the expanded mineral pieces from the material outlet of the cyclone to a bagging station. The relatively cool air used to convey the mineral pieces from the cyclone to the bagging station cools the mineral pieces to an adequate bagging temperature.

A major drawback associated with the use of an air conveyor system for conveying expanded mineral pieces is that most of the larger pieces are reduced to smaller pieces. Indeed, repeated contact between the expanded mineral pieces and the walls of the tubes forming the air conveyor lead to the crumbling of the larger pieces. The consequences of this crumbling action are a higher level of dust and smaller expanded mineral pieces in the expanded material to be put in sacks, which is often undesirable.

Another solution to the cooling problem is to replace the cyclone by a large sitting box to hold a quantity of expanded material while it cools. A major drawback with this solution consists in the large size of the sitting box. Indeed, when the expansion process is continuous, the sitting box must hold a huge quantity of expanded material to allow it to cool properly.

OBJECTS OF THE INVENTION

An object of the present invention is therefore to provide an aerated power driven belt conveyor system for conveying hot material.

SUMMARY OF THE INVENTION

More specifically, in accordance with the present invention, there is provided an aerated belt conveyor system for conveying expanded mineral material comprising:

an elongate frame defining a material conveying path;

a power driven belt conveyor mounted longitudinally to the elongate frame; said belt conveyor having a first end and a second end;

a longitudinal envelope means for enclosing the belt conveyor, the envelope means comprising air intake means and air exhaust means spaced apart from the air intake means;

a material inlet for supplying expanded mineral material to the belt conveyor;

a material outlet for receiving mineral material conveyed to the second end of the belt conveyor; and means for producing a flow of air in the envelope from the air intake means to the air exhaust means, for the purpose of aerating expanded mineral material conveyed onto the power driven belt conveyor.

The power driven belt conveyor prevents the expanded mineral material from being crushed during transport while the air flow in the envelope cools the mineral material to an adequate bagging temperature.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
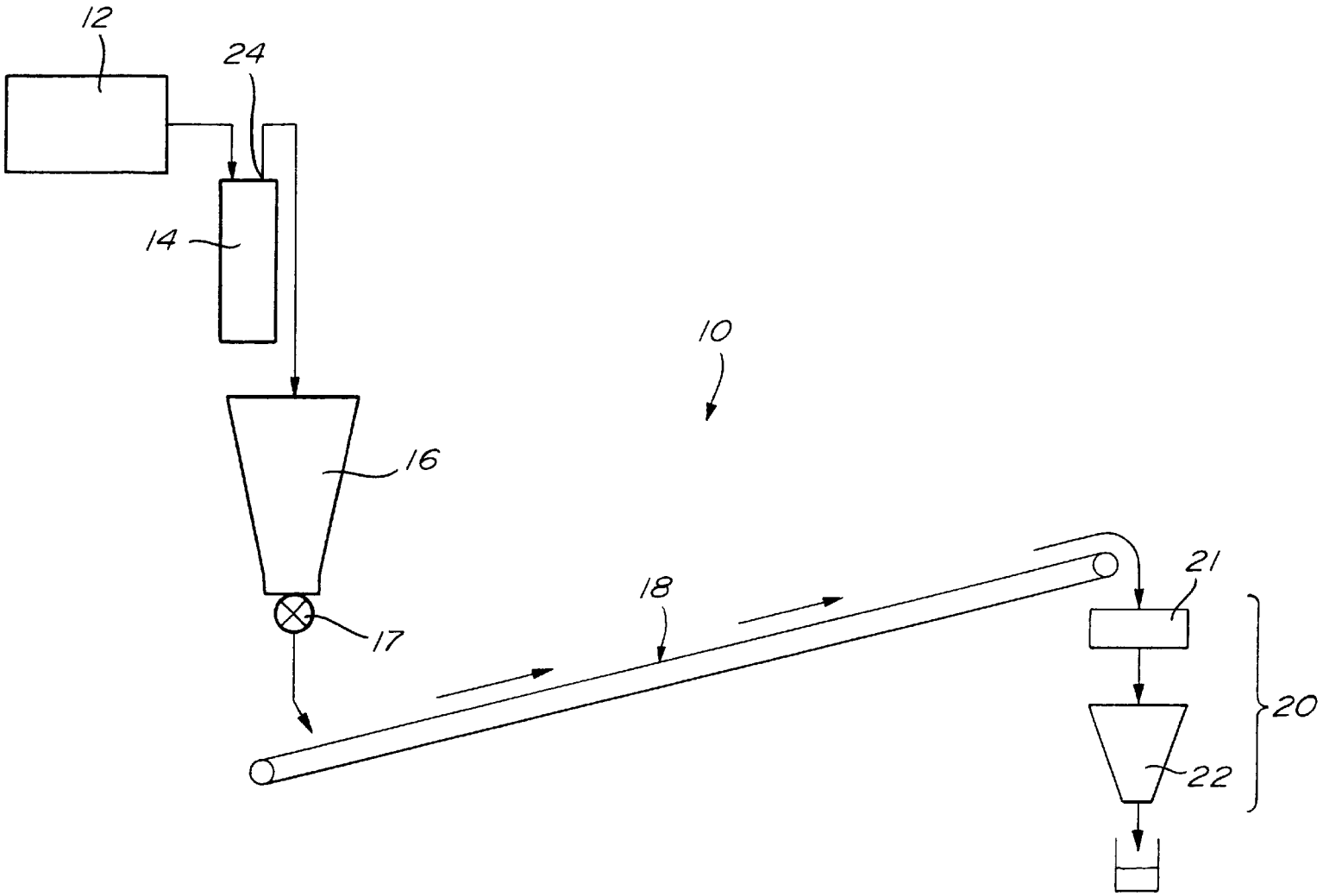
FIG. 1 is a schematic view illustrating a mineral expansion system.
Figure 2:
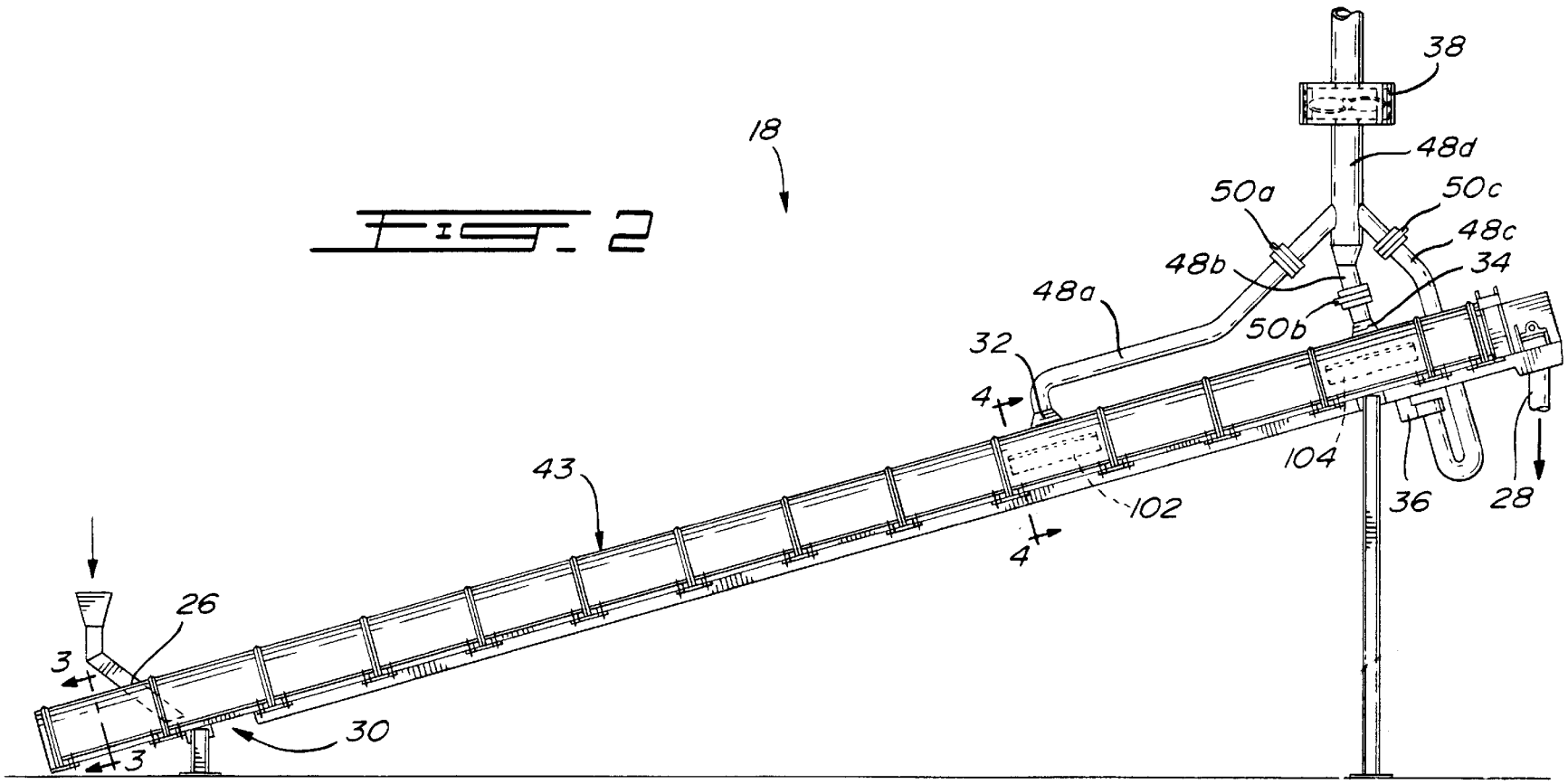
FIG. 2 is a side elevational view of an aerated belt conveyor system according to an embodiment of the present invention.

FIG. 1 of the appended drawings schematically illustrates a system 10 for expanding perlite according to a continuous process. The system 10 includes a perlite ore feed reservoir 12, an expansion kiln 14, a cyclone 16, an air-lock valve 17, an aerated conveyor system 18 and a bagging station 20 including a sifting device 21 and a bagging funnel 22.

The general operation of the expansion system 10 will now be briefly described. First, the perlite ore is continuously transferred, at a predetermined rate, from the reservoir 12 to the expansion kiln 14. The high temperature in the kiln 14 cause the expansion of the perlite ore.

To keep the perlite ore in the kiln 14 until the perlite ore is in an expanded form, an expanded perlite outlet 24 of the kiln 14 is provided at an upper portion of the kiln 14 and a gas burner (not shown) is provided at a lower portion of the kiln 14. Once the perlite pieces are expanded and therefore less dense, they are upwardly pushed towards the outlet 24 by the rising hot exhaust gases of the gas burner. It is to be noted that other techniques could be used to keep the perlite ore in the kiln 14 until it is in an expanded form.

The expanded perlite pieces exiting the kiln 14 are transferred to the cyclone 16 where the hot exhaust gases of the kiln 14 and the hot expanded perlite pieces are separated. As discussed hereinabove, the cyclone 16 also has the side effect of partially cooling the hot expanded perlite pieces. The expanded perlite pieces exiting the cyclone 16 are often at temperatures exceeding 1500° F. (800° C.).

Then, the hot expanded perlite pieces are transferred from the cyclone 16 to the conveyor 18 through the air-lock valve 17. The purpose of the air-lock valve 17 is to prevent air from entering the cyclone 16 through its outlet. The perlite pieces are conveyed from the cyclone 16 to the bagging station 20 by the aerated conveyor system 18, which will be described in greater details hereinafter. The aerated conveyor system 18 serves the dual purposes of conveying the expanded perlite to the bagging station 20 where it may be bagged for subsequent transport, and cooling the expanded perlite to an adequate bagging temperature.

The cooled expanded perlite pieces are then sifted by the sifting device 21 to remove perlite dust and small expanded perlite pieces from the final product.

Finally, the cooled and sifted expanded perlite pieces are bagged at an outlet of the bagging funnel 22.

It is to be noted that many advantages arise from the use of the aerated conveyor system 18 instead of a conventional air conveying system for conveying hot expanded perlite pieces. For example, the resulting cooled expanded perlite material consists of pieces that are, on average, larger since the expanded perlite pieces are not conveyed at high velocity within conveying tubes. Indeed, the repeated contacts between the expanded perlite and the walls of the conveying tubes cause the crumbling of large perlite pieces into smaller ones. Consequently, the use of the aerated conveyor system causes (a) a reduction of the amount of perlite dust removed by sifting, (b) an increase of the quality of the final product since the perlite pieces are on average larger, and (c) an increase of the overall cost efficiency of the perlite expansion process since expanded perlite material is usually sold by the volume. For example, 4 cubic feet (0.11 $m^3$) of expanded perlite conveyed with the conveyor 18 of the present invention may weight as low as 20 pounds (9 kg).

Another consequence of the production of larger pieces of expanded perlite is the reduction of the amount of dust in the perlite expansion plant, which provides a better working environment.

It is to be noted that the various elements forming the continuous perlite expansion system described hereinabove are given for illustrative purpose only. Some of these elements could be omitted or divided into multiple elements. For example, the expansion kiln 14 may include a pre-heater (not shown) to pre-heat the perlite ore before the introduction in the expansion kiln proper.

Turning now to FIGS. 2–5 an aerated conveyor system 18 according to a preferred embodiment of the present invention will be described in greater details.

Figure 3:
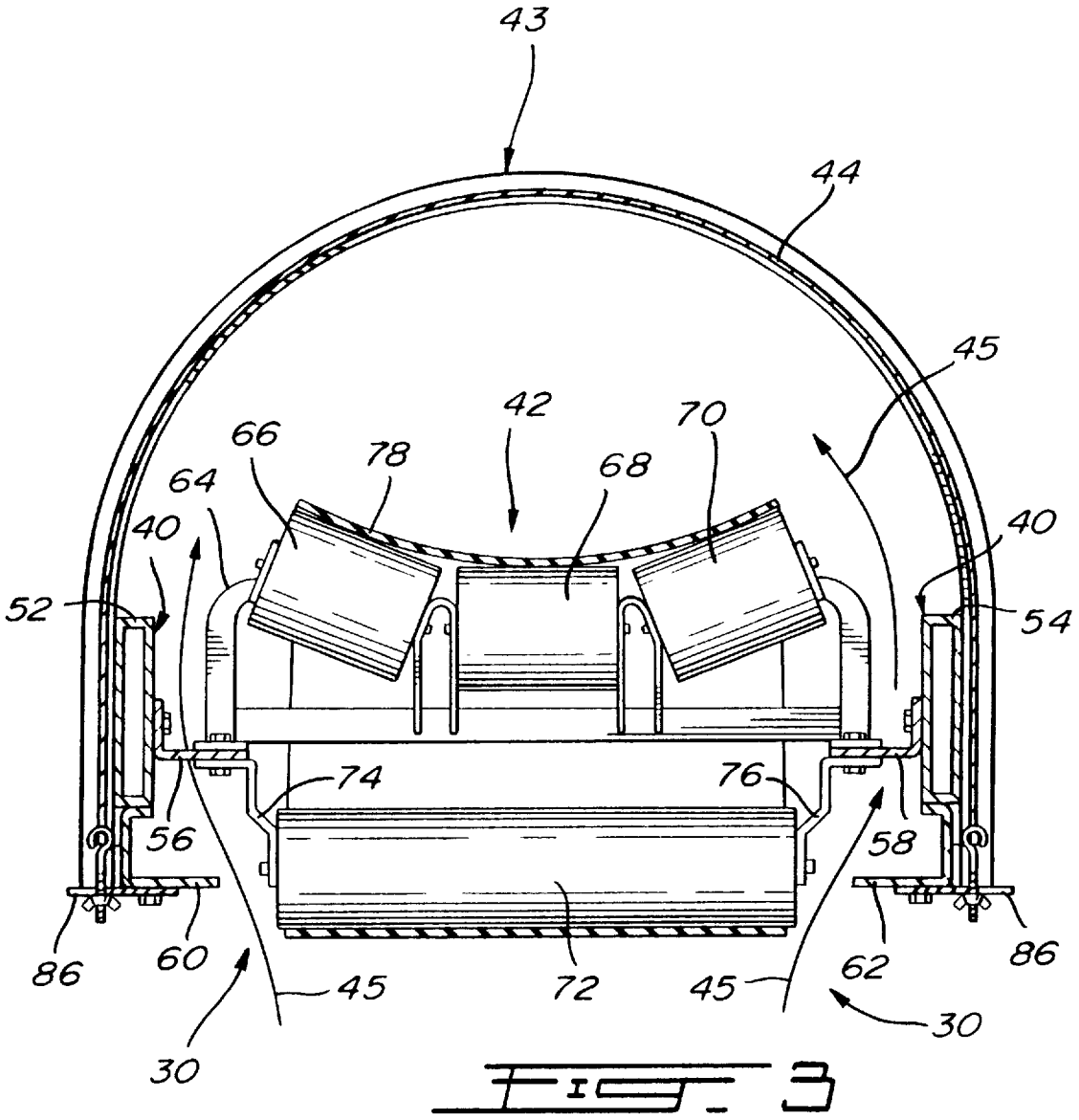
FIG. 3 is a sectional view taken along line 3—3 of FIG. 2.
Figure 4:
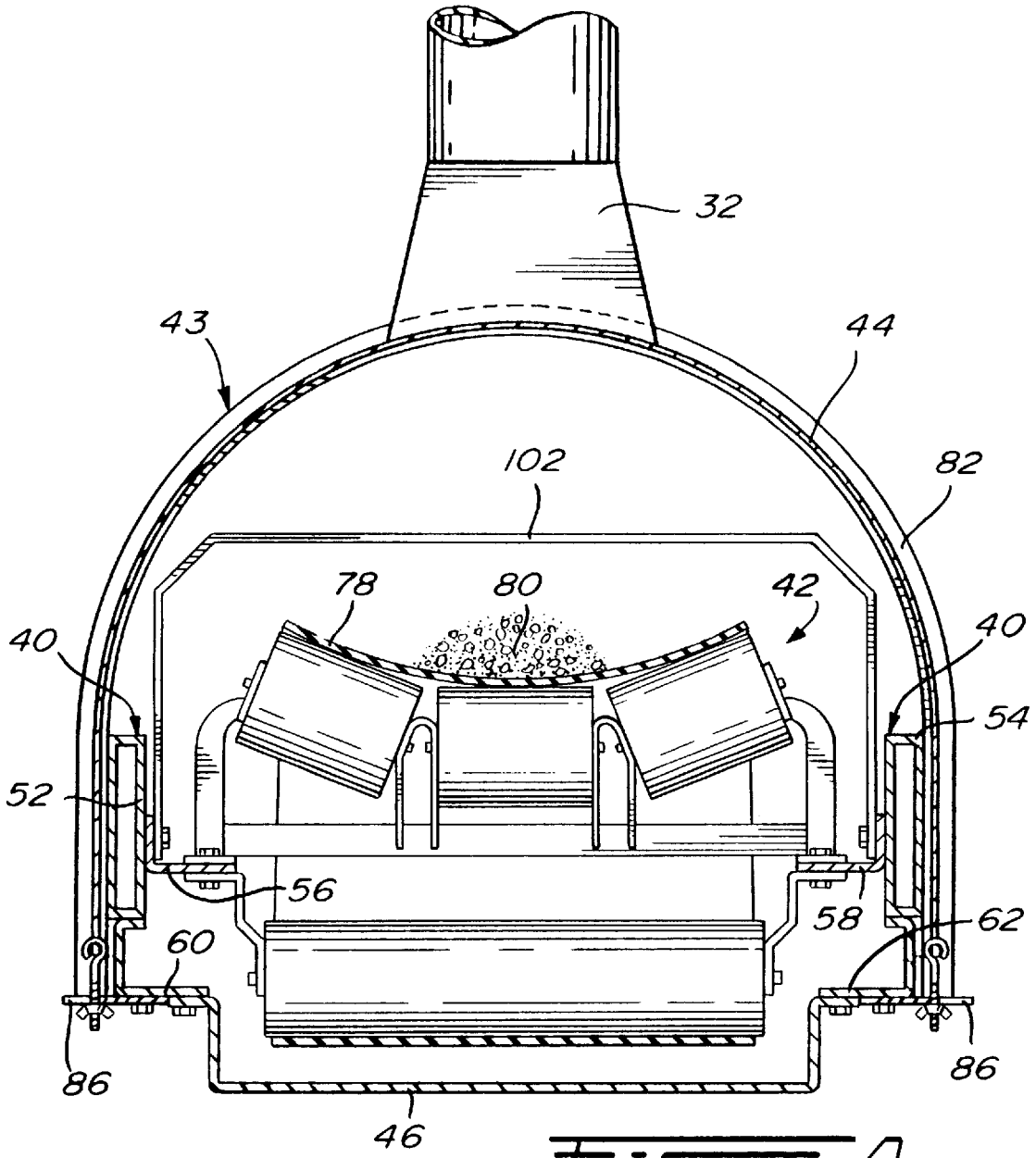
FIG. 4 is a sectional view taken along line 4—4 of FIG. 2.

The aerated conveyor system 18 includes a material inlet 26, a material outlet 28, an air intake 30, three air exhaust ports 32, 34 and 36, an exhauster 38 and, as can be better seen from FIGS. 3 and 4, an elongate frame 40, a power driven belt conveyor 42 and an envelope 43 formed by a hood assembly 44 and a sealing bottom wall 46 (FIG. 4).

The material inlet 26 is connected to a source of hot expanded perlite pieces, for example the outlet of a cyclone 16 (FIG. 1), while the material outlet 28 is connected to a bagging station (see numeral 20 in FIG. 1) for bagging the cooled expanded perlite pieces.

The air intake 30 is formed by the removal of a portion of the sealing bottom wall 46 in the vicinity of the material inlet 26 to thereby allow fresh air to enter the envelope 43 (see arrows 45 in FIG. 3). The three air exhaust ports 32, 34 and 36 are connected to the exhauster 38 through air ducts 48*a*–48*d* thereby allowing the production of a flow of air in the envelope 43 by the exhauster 38. This air flow may be adjusted by blast gates 50*a*, 50*b* and 50*c*, mounted to the air ducts 48*a*, 48*b* and 48*c*, respectively, to selectively restrict the flow of air in the ducts and therefore the flow of air in the envelope 43.

As can be seen in FIGS. 3 and 4, the elongate frame 40 includes a pair of longitudinal hollow metallic beams 52, 54, a pair of L-shaped irons 56, 58 to which the power driven belt conveyor 42 is mounted, and a pair of J-shaped irons 60, 62 to which the envelope 43 is mounted.

The power driven belt conveyor 42 includes a support 64 to which three rollers 66, 68 and 70 are mounted and a return roller 72 mounted to irons 56, 58 through brackets 74, 76, respectively. An endless belt 78 is engaged to the rollers 66, 68, 70 and 72 and is connected to a conventional conveyors actuating mechanism (not shown).

The upwardly facing portion of the endless belt 78 is concavely supported by the three rollers 66, 68 and 70 so as to better support the expanded perlite (see numeral 80 in FIG. 4) supplied to the endless belt through the material inlet 26.

Turning now to FIG. 4, the sealing bottom wall 46 is mounted to the J-shaped irons 60 and 62 of the frame 40 under the power driven belt conveyor 42. The sealing bottom wall 46 is formed of a plurality of individual generally U-shaped wall sections, one of which having been removed to form the air intake 30 as previously mentioned.

The hood assembly 44 includes a plurality of arcuate rigid supports 82 secured to the J-shaped irons 60 and 62 on either sides of the power driven belt conveyor 42 at regular intervals. Plates of flexible sheet metal 84 forming hood covers are mounted between the arcuate supports 82, following the arc of the supports 82 and are secured to the frame 40 by hood securing brackets 86.

Figure 5:
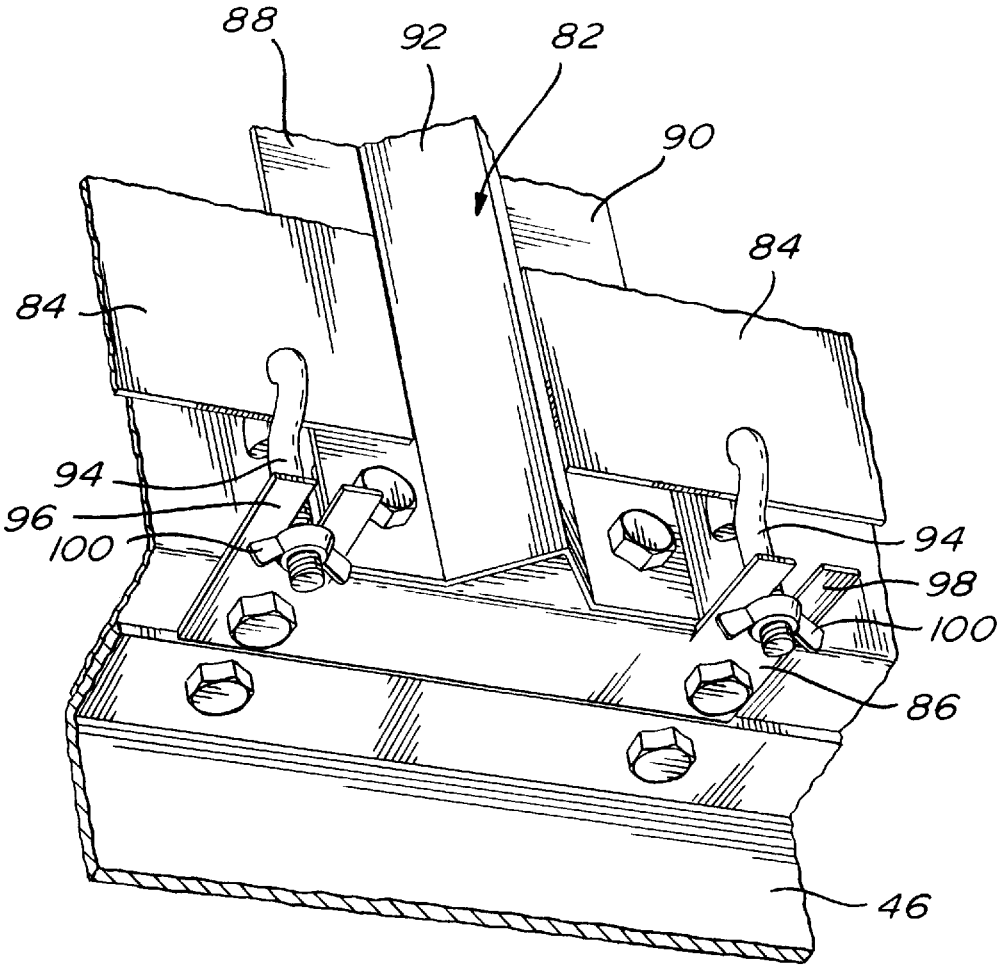
FIG. 5 is a perspective view illustrating a hood securing bracket.

As can be better seen from FIG. 5, the arcuate supports 82 include two flat portions 88 and 90 linked by an inverted V portion 92. Each sheet metal plate 84 is supported by one of the flat portions 88, 90 and is secured to the frame 40 through the brackets 86 and fasteners 94. Each bracket 86 includes two forked portions 96 and 98 to which the fasteners 94 may be secured. The fasteners 94 include a wing nut 100 that may easily be loosened to free the sheet metal plates 84 from the frame 40. The brackets 86 allows quick assembly and disassembly of the hood 44.

The belt conveyor system 18 further includes first and second air deflecting elements 102, 104 respectively mounted to the frame 40 between the upwardly facing portion of the endless belt 78 and the air exhaust ports 32, 34. The purpose of the deflecting elements 102 and 104 is to prevent the light expanded perlite pieces 80 conveyed on the belt 78 from entering the air exhaust ports 32 and 34 under the influence of the air flow generated by the exhauster 38.

The blast gates 50*a*–50*c* allow the air flow generated by the exhauster 38 in the envelope 43 to be adjusted to minimize unwanted movements of the perlite pieces 80 onto the conveyor belt 78.

In operation, hot expanded perlite continuously enters the aerated belt conveyor system at a predetermined rate through the material inlet 26 and is conveyed on the belt 78 towards the material outlet 28. The exhauster 38 creates a flow of air between the air intake 30 and the air exhaust ports 32, 34 and 36. The fact that the surface of the air intake 30 is significantly larger that the surface of the air exhaust ports 32, 34 and 36, combined, cause a velocity reduction of the air entering the envelope 43 through the air intake 30. This reduced velocity of the air entering is an advantage since the lower velocity air is less likely to displace the low weight expanded perlite pieces 80.

The flow of air present in the envelope cools the hot perlite pieces entering the conveyor system 18 while they are conveyed from the material inlet 26 to the material outlet 28.

It is to be noted that the relatively long contact time between the air and the perlite pieces to be cooled enables the use of a relatively low air flow in the envelope 43.

Adequate cooling has been done on an aerated conveyor according to the present invention and having the following characteristics:

| | |
|---|---|
| Length of the conveyor: | 60 feet (≈18.30 meters) |
| Width of the conveyor: | 18 inches (≈0.457 meters) |
| Linear speed of the endless belt: | 45 feet/minute (≈0.23 m/s) |
| Hot perlite feed rate: | 6 cubic feet/minute (CFM) (≈0.28 $m^3$/s) |
| Fresh air intake: | 3000 to 5000 CFM (≈1.4 to 2.3 $m^3$/s) |
| Temperature of the hot perlite at the inlet: | 1500° F. (≈800° C.) |
| Temperature of the cooled perlite at the outlet: | 4800° F. (≈250° C.) |

It is to be noted that, in the present disclosure, examples and descriptions have been given with reference with perlite ore but that the aerated conveyor of the present invention could be used with any hot expanded mineral or with any hot and light material.

As will be apparent to one skilled in the art, air filters (not shown) could be used between the air exhaust ports and the exhauster 38 to remove the dust present in the air drawn in the envelope.

Finally, it is also to be noted that while the conveyor system 18 is illustrated in the appended drawings as ascending from the material inlet 26 to the material outlet 28, the conveyor system 18 could be level if the expanded material outlet 28 did not have to be elevated for adequate bagging.

Although the present invention has been described hereinabove by way of preferred embodiments thereof, it can be modified, without departing from the spirit and nature of the subject invention as defined in the appended claims.

What is claimed is:

1. An aerated belt conveyor system for conveying expanded mineral material comprising:

an elongate frame defining a material conveying path;

a power driven belt conveyor mounted longitudinally to said elongate frame; said belt conveyor having a first end and a second end;

a longitudinal envelope means for enclosing said belt conveyor, said envelope means comprising air intake means and air exhaust means spaced apart from said air intake means; said air intake means being larger than said air exhaust means;

a material inlet for supplying expanded mineral material to said belt conveyor;

a material outlet for receiving mineral material conveyed to said second end of said belt conveyor; and means for producing a flow of air in said envelope from said air intake means to said air exhaust means, for the purpose of aerating expanded mineral material conveyed onto said power driven belt conveyor; said air flow producing means include means for drawing air from said longitudinal envelope.

2. An aerated belt conveyor system as defined in claim 1, wherein said air drawing means are connected to said air exhaust means of said longitudinal envelope for drawing air through said air intake to thereby produce said air flow from said air intake means to said air exhaust means.

3. An aerated belt conveyor system as defined in claim 2, wherein said envelope includes hood assembly mounted to said elongate frame over said belt conveyor.

4. An aerated belt conveyor system as defined in claim 3, wherein said air drawing means includes an exhauster having an air intake.

5. An aerated belt conveyor system as defined in claim 4, wherein said air exhaust means includes at least one aperture provided in said longitudinal hood; said air drawing means includes at least one air duct each having a first end secured to one of said at least one aperture of said air exhaust means, and a second end secured to said air intake of said exhauster.

6. An aerated belt conveyor system as defined in claim 5, wherein said envelope also includes a sealing bottom wall assembly mounted to said elongate frame under said belt conveyor.

7. An aerated belt conveyor system as defined in claim 6, wherein said sealing bottom wall assembly defines at least one aperture which is pneumatically connected to said air intake of said exhauster through air ducts.

8. An aerated belt conveyor system as defined in claim 5, wherein said power driven belt conveyor includes a plurality of rollers mounted to said elongate frame, an endless belt mounted to said rollers and actuating means associated to the endless belt to bring the endless belt in rotation.

9. An aerated belt conveyor system as defined in claim 8, further comprising air deflector means mounted to said elongate frame between said endless belt and each said at least one aperture of said hood assembly, said air deflector means preventing said expanded mineral material from being drawn in through said at least one apertures of said hood assembly by said air drawing means.

10. An aerated belt conveyor system as defined in claim 9, wherein said air deflector means include a longitudinal plate mounted between said endless belt and one of said at least one aperture of said hood assembly.

11. An aerated belt conveyor system as defined in claim 1, wherein said air intake means are provided in the vicinity of said first end of said belt conveyor.

12. An aerated belt conveyor system as defined in claim 1, further including means to adjust said air flow produced by said air flow producing means.

13. An aerated belt conveyor system as defined in claim 12, wherein said adjusting means include at least one blast gate.

14. An aerated belt conveyor system as defined in claim 5, further including means to adjust the air flow produced by said exhauster.

15. An aerated belt conveyor system as defined in claim 14, wherein said adjusting means include at least one blast gate mounted to said at least one air duct.

16. An aerated belt conveyor system for conveying expanded mineral material comprising:

an elongate frame defining a material conveying path;

a power driven belt conveyor mounted longitudinally to said elongate frame; said belt conveyor having a first end and a second end;

a longitudinal envelope means for enclosing said belt conveyor, said envelope means comprising air intake means and air exhaust means spaced apart from said air intake means; said longitudinal envelope including a plurality of hood sections; each said hood section including an arcuate transversal member mounted over said belt conveyor and a flexible cover to be secured to said arcuate transversal member through fastening means;

a material inlet for supplying expanded mineral material to said belt conveyor;

a material outlet for receiving mineral material conveyed to said second end of said belt conveyor; and means for producing a flow of air in said envelope from said air intake means to said air exhaust means, for the purpose of aerating expanded mineral material conveyed onto said power driven belt conveyor; said air flow producing means include means for drawing air from said longitudinal envelope; said air drawing means being connected to said air exhaust means of said longitudinal envelope for drawing air through said air intake to thereby produce said air flow from said air intake means to said air exhaust means.

17. An aerated belt conveyor system as defined in claim 16, wherein each said fastening means includes (a) a forked element mounted to said power driven conveyor and (b) a fastening element mounted to said hood element; said fastening element being configured and sized to be removably connected to said forked element.

* * * * *